United States Patent [19]

Brickman

[11] Patent Number: 4,625,655

[45] Date of Patent: Dec. 2, 1986

[54] FOLDABLE TABLE HAVING STORAGE CAPABILITIES

[76] Inventor: Harold Brickman, 2911 W. Catalpa, Chicago, Ill. 60625

[21] Appl. No.: 639,200

[22] Filed: Aug. 9, 1984

[51] Int. Cl.[4] ..... A47B 85/00

[52] U.S. Cl. ..... 108/25

[58] Field of Search ..... 108/25, 149; 312/5, 312/6, 3

[56] References Cited

U.S. PATENT DOCUMENTS

| | | | |
|---|---|---|---|
| 2,197,992 | 4/1940 | Baxter | 108/25 X |
| 2,494,164 | 1/1950 | De Puy et al. | 108/25 X |
| 2,524,873 | 10/1950 | Baxter | 108/25 X |
| 2,533,725 | 12/1950 | Eisenberg | 312/5 X |
| 2,639,819 | 5/1953 | Marks | 108/149 X |
| 2,677,585 | 5/1954 | La Voy | 312/5 |
| 3,760,943 | 9/1973 | Reader | 312/3 X |
| 3,904,258 | 9/1975 | Faulkenberry | 312/6 |
| 4,122,780 | 10/1978 | Brickman | 108/25 |
| 4,177,737 | 12/1979 | Brickman | 108/25 X |
| 4,466,659 | 8/1984 | Carpentier et al. | 108/149 X |

*Primary Examiner*—William E. Lyddane
*Assistant Examiner*—José V. Chen
*Attorney, Agent, or Firm*—McDougall, Hersh & Scott

[57] ABSTRACT

A foldable table and storage devices is constituted by a flexible table panel mounted on a cross bar extending between pairs of hinged legs. A bottom panel is attached to the underside of the table panel and is provided with a center portion spaced from the table panel when the table is opened to support articles extending through the table panel.

2 Claims, 5 Drawing Figures

FIG. 1
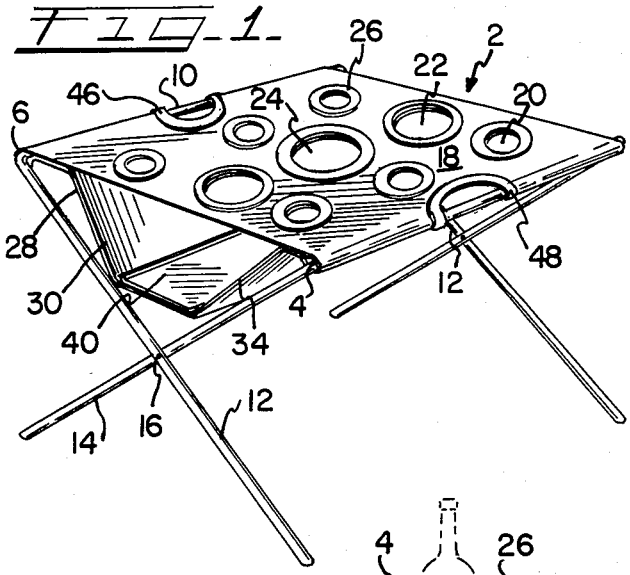
FIG. 3
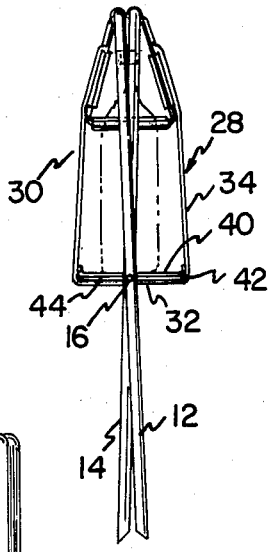
FIG. 4
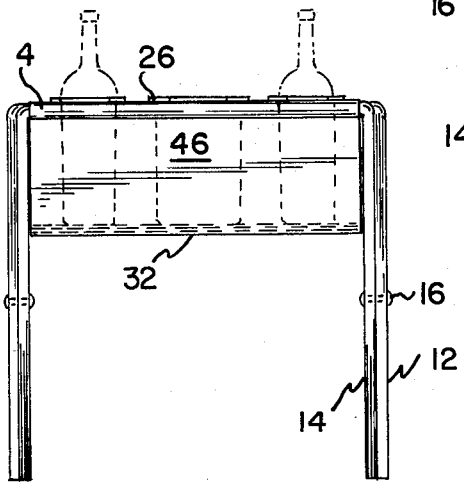
FIG. 5
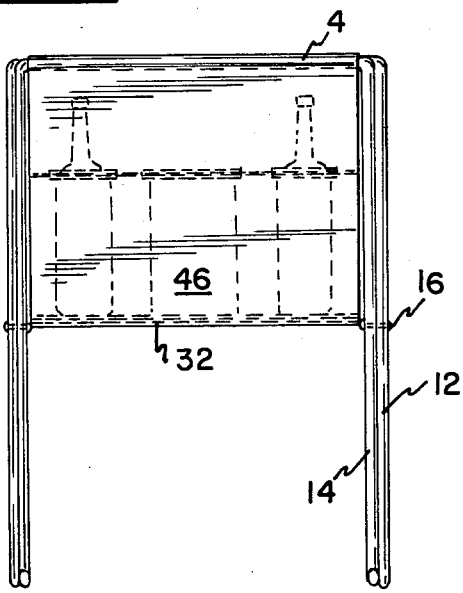
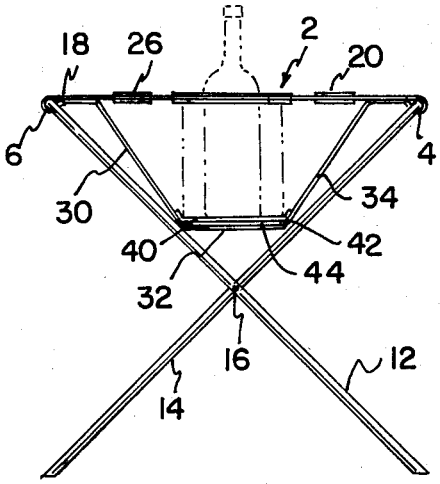
FIG. 2

FOLDABLE TABLE HAVING STORAGE CAPABILITIES

BACKGROUND OF THE INVENTION

This invention relates generally to foldable tables. More specifically it relates to improvements in such tables having flexible panels provided with openings to accomodate articles intended for beverage consumption for use and storage purposes.

In copending application Ser. No. 579,489 filed Feb. 13, 1984 by Leon Soren for "Foldable Table" and assigned to the same assignee as is this application, a foldable bar table is disclosed using a rigid center portion for holding various bar items. Referenced in that application are Pat. Nos. 4,122,780, 4,177,738 and Design No. 252,659.

It is believed that certain advantages in ease of manufacture, cost and appearance can be had by the use of more flexible panels to provide a table surface and the bar article supporting means.

Therefore, it is an object of this invention to provide a novel foldable table utilizing flexible panels for both the table surface and the article supporting means.

BRIEF SUMMARY OF THE INVENTION

The foregoing and other objects of the invention are achieved in one embodiment of the invention wherein a flexible panel is secured to a pair of pivotable legs and provided with openings to receive bar articles. A second flexible panel beneath the table provides a support for the bar articles. The relative dimensions are such that when the table is open, the second panel is spaced from the table panel so that articles passed through the openings therein are supported on the upper surface of the second panel. When folded the dimensions are such that articles held in the table may remain therein for storage purposes.

BRIEF DESCRIPTION OF THE DRAWINGS

The invention itself is set forth in the claims appended hereto and forming a part of this specification while an understanding of an embodiment thereof may be had by reference to the detailed description and drawings in which:

FIG. 1 is a perspective illustration of an embodiment of the invention showing it in the in use or open position;

FIG. 2 is an end view of the embodiment of FIG. 1 showing it in an open position;

FIG. 3 is an end view of the embodiment of FIG. 1 showing it in the closed or storage position;

FIG. 4 is a side view of the embodiment of FIG. 1 showing it in an open position; and FIG. 5 is a side view of the embodiment of FIG. 1 showing it in the closed or storage position.

DETAILED DESCRIPTION

Referring to FIGS. 1, 2 and 4, a foldable table in accordance with the invention comprises a table panel 2 formed from a flexible material such as canvas or plastic. Formed in a generally rectangular shape, the table panel is formed with loops 4 and 6 at its opposite ends. The loops encompass cross bars 8 and 10 of a first and second pair of legs 12 and 14 formed generally as U-shaped structures. The loops in the table structure may be formed by sewing, bonding by the use of an adhesive, or by thermally bonding a plastic material.

The legs 12 and 14 are pivotally mounted to each other as shown at 16 for rotation in a manner and for a purpose to be described hereinafter.

The table panel when open provides a flat surface 18. An opening or a plurality of them such as shown at 20, 22 or 24, are provided in the surface 18 to receive articles used in the consumption of beverages or food. Openings such as those shown at 20 may, for instance, be of a size to permit glasses or other drinking containers to pass partially therethrough so that if a tapered glass is used, its top will extend above the table surface to be grasped by a user. The openings 22 can be of a size to receive bottles of various sizes. The opening 24 can be dimensioned to permit an ice bucket to be supported therein. Any one or all of the openings may be surrounded by a strengthening ring such as shown at 26. The strengthening ring can consist of a plastic or fiber ring encompassing the opening and bonded around the periphery of the opening for strength and/or appearance purposes.

Providing support for all or some of the articles extending through the openings in the table surface is a second or bottom flexible panel 28. This panel consists of three sections. As shown in the drawings, these include a left hand section 30, a center section 32 and a right hand section 34. The outer ends of the left and right hand sections are attached to the table panel along lines slightly inward of the loops 4 and 6. These attachments may be achieved by sewing or bonding in some other fashion.

When the table is in the open position, the section 30 extends downwardly at an angle toward the center while the center section 32 is substantially horizontal. The section 34 extends upwardly at an angle from the center section to the line of its attachment to the table panel. To provide a level article supporting surface, the lower panel is provided at its center portion 32 with an overlying portion 40 extending over its width and length. The portion 40 is attached to the center portion 32 along its lines of juncture with the portions 30 and 34 and forms a pocket 42 into which a stiffening member 44, such as a sheet of relatively stiff fiberboard or plastic, may be inserted. By this means the center portion is made to be relatively rigid and capable of supporting an article resting thereon without excessive bending.

In the use of the table, it may be opened as shown in FIGS. 1, 2 and 3 or closed as shown in FIGS. 3 and 5. As stated, articles used in the consumption of beverages may be inserted in the openings 20, 22 or 24. Such articles could include a beverage bottle as shown in dotted lines in FIGS. 2–4. Another such article could be an ice bucket as shown at 46 in FIGS. 2, 4 and 5. When the table is open, as may be seen, the table panel is held in a relatively taut position, being stretched somewhat by the open position of the legs 12 and 14. In this position, the ice bucket passing, for instance, through the opening 24 and bottles passing through the openings 22 will rest on or be supported by the relatively rigid portion 32 of the lower panel 28. Glasses, not shown, will extend partially through the openings 20. In the open position, the tops of the bottles will extend above the surface of the table panel so that they may be handled by a user.

The table may be folded by grasping the cross bars 8 and 10 at the cutaway portions 46 and 48 provided at approximately the center of the table panel 18, to bring them together to cause the legs 12 and 14 to pivot about 16. When this is done, the table will assume essentially the configuration shown in FIGS. 3 and 5. The center portion 32 of the lower panel 28 will move downwardly, causing the articles resting thereon to move downwardly through the openings 22 and 24, so that any articles passing through those openings and resting on the center panel will now be completely enclosed by the folded table panel. In this position the table, together with the articles it encases, may then be easily transported to a storage location until its use is desired again. As may be seen in FIG. 5, the dimensions are such that the bottles and ice bucket shown in dotted lines are now housed within the area enfolded by the table panel 2.

Obviously there may be variations and modifications in the design details of this invention as, for instance, the dimensional relationships, the number and location of the article receiving openings in the table panel, and the choice of materials, and it is intended by the claims appended hereto and forming a part of this specification to cover all such and other variations as come within their scope.

What is claimed as new and desired to be secured by Letters Patent is:

1. A foldable table comprising two pairs of legs pivotally joined intermediate their lengths and having a cross bar connecting each of a pair, a table panel formed from a flexible material attached at opposite ends to said cross bar, said table panel having openings therein for receiving articles used in the consumption of beverages and the like, a lower panel extending beneath said table panel and attached at its opposite ends to said table panel, said lower panel having a relatively rigid center section comprising a section attached to said center section at its ends and forming a pocket and a relatively rigid member inside of said pocket extending below at least some of said openings and having side panels inclined upwardly to the bottom of said table panel when said table is in an open position to provide support for articles extending through said openings and wherein said lower panel is dimensioned so that its center section is spaced below said table panel when the table is in an open position to provide space sufficient to permit articles placed in said openings above said center section to have portions extending below said table panel and supported on said center section.

2. A foldable table comprising two pairs of legs pivotally joined intermediate their lengths and having a cross bar connecting each of a pair, a table panel formed from a flexible material attached at opposite ends to said cross bar, said table panel having openings therein for receiving articles used in the consumption of beverages and the like, a lower panel extending beneath said table panel and attached at its opposite ends to said table panel, said lower panel having a relatively rigid center section comprising a section attached to said center section at its ends and forming a pocket and a relatively rigid member inside of said pocket extending below at least some of said openings and having side panels inclined upwardly to the bottom of said table panel when said table is in an open position to provide support for articles extending through said openings.

* * * * *